US005580295A

United States Patent [19]

Ruzskai et al.

[11] Patent Number: 5,580,295

[45] Date of Patent: Dec. 3, 1996

[54] ARMS FOR A TOY FIGURE

[75] Inventors: Frank Ruzskai, Copenhagen; Bent Landling, Nye Glim, Roskilde; Synnøve Vatakar, Søborg, all of Denmark

[73] Assignee: INTERLEGO AG, Baar, Switzerland

[21] Appl. No.: 495,495

[22] PCT Filed: Jan. 26, 1994

[86] PCT No.: PCT/DK94/00043

§ 371 Date: Oct. 18, 1995

§ 102(e) Date: Oct. 18, 1995

[87] PCT Pub. No.: WO94/16788

PCT Pub. Date: Aug. 4, 1994

[30] Foreign Application Priority Data

Jan. 27, 1993 [DK] Denmark ..... 0095/93

[51] Int. Cl.[6] ..... A63H 3/46

[52] U.S. Cl. ..... 446/378; 446/376; 446/390

[58] Field of Search ..... 446/376, 378, 446/390

[56] References Cited

U.S. PATENT DOCUMENTS

| | | | |
|---|---|---|---|
| 973,485 | 10/1910 | Dorsey | 446/378 |
| 2,925,944 | 2/1960 | Inserillo | 446/376 |
| 3,477,171 | 11/1969 | Bonanno . | |
| 3,995,395 | 12/1976 | Rahmstorf . | |
| 5,380,233 | 1/1995 | Numoto | 446/378 |

FOREIGN PATENT DOCUMENTS

| | | | |
|---|---|---|---|
| 739163 | 7/1966 | Canada | 446/376 |
| 634825 | 2/1928 | France | 446/378 |
| 194807 | 2/1908 | Germany | 446/376 |
| 653113 | 2/1963 | Italy | 446/378 |
| 8703502 | 6/1987 | WIPO . | |

*Primary Examiner*—Robert A. Hafer
*Assistant Examiner*—Jeffrey D. Carlson
*Attorney, Agent, or Firm*—Kane, Dalsimer, Sullivan, Kurucz, Levy, Eisele and Richard, LLP

[57] ABSTRACT

A toy figure having rotatable arms which protrude from the body of the figure. The arms are rotationally coupled to each other so that they have a limited mutual rotatability.

2 Claims, 2 Drawing Sheets

ARMS FOR A TOY FIGURE

BACKGROUND OF THE INVENTION

The invention concerns a toy figure having a body and two opposed shoulders on the body and having two arms which are rotatably mounted with a common axis of rotation in their respective shoulders, wherein each arm protrudes from the body in the direction of the axis of rotation and defines respective outer points and moreover protrudes asymmetrically transversely to the axis of rotation, and wherein the figure has a height transversely to the axis of rotation which is greater than the distance between the outer points of the arms measured in the direction of the axis of rotation.

Such toy figures are known and are used in particular by minor children. It is desired by manufacturers as well as users that the same toy series includes figures in various sizes which simulate adults and children, respectively, and these are frequently manufactured also in small dimensions so that even quite small children can handle the figures.

For reasons of safety some national regulations fix a lower limit of the dimensions of all toys which are contemplated for use by small children, e.g. below 3 years. Such safety regulations e.g. lay down that such toys—including the present toy figures—must not be capable of being passed through a circular, cylindrical hole having a specified diameter and length. The purpose of this is to ensure that the children cannot swallow the toy and thereby be injured.

Of course, such safety regulations can be observed by generally giving the figure suitably large dimensions. However, this solution is undesirable, because it must be possible to manufacture small figures which simulate children and which dimensionally match larger figures which simulate adults, while maintaining a suitable difference in size so that the users clearly regard the figures as children and adults, respectively.

SUMMARY OF THE INVENTION

A critical dimension of said safety test of toy figures is the transverse dimension, since this dimension is frequently smaller than the height of the figures. It is possible to allow the arms to protrude sufficiently from the body for the figure to observe the safety regulations. However, it is also desired that the hands on the arms of the figures should be arranged at a specific mutual distance, so that large as well as small figures can fit into an already determined and established toy program, in which e.g. the gripping distance of the hands is the same for large and small figures in the same series.

On toy figures of the type mentioned here the arms can perform a rotary movement in the shoulder joints, and for a lifelike function and thereby great play value for the children to be achieved, it is desirable that the arms can rotate independently of each other. As will appear from FIG. 1, small figures, which generally have expedient proportions, but whose arms can rotate freely with respect to each other, can pass through the hole in the shown test tool when the arms are e.g. arranged in the shown position in which one arm points upwardly and the other arm points downwardly. This problem can be solved by mounting the arms fixedly and in co-parallel on a common, rigid shaft, so that both arms always point the same way. This is shown in FIG. 2. Such a toy figure having rigidly connected arms does not have a sufficiently lifelike function—and thus not a sufficiently high play value for the users either.

In other words, it is desirable to have small toy figures of the present type in which the arms have a certain mutual movability, and which also observe all national and international safety regulations. The object of the invention is to provide such a toy figure.

This object is achieved by a toy figure of the present type in which the arms are rotationaly coupled to each other so that they have a predetermined and limited mutual rotatability.

In such a toy figure the arms have a lifelike movability in the shoulder joints, which gives the desired, high play value for the children. The limited mutual rotatability ensures that the arms cannot be arranged as shown in FIG. 1, and the figure therefore observes the relevant safety regulations.

The predetermined and restricted mutual rotatability can advantageously be obtained in that each of the arms has engagement parts which, in the direction of the axis of rotation, protrude inwardly over corresponding engagement parts on the respective other arm and are adapted to rotationally engage these, so that the rotational engagement has a predetermined angular clearance.

BRIEF DESCRIPTION OF THE DRAWINGS

A preferred embodiment of the invention will be described more fully below with reference to the drawing, in which.

DETAILED DESCRIPTION OF THE DRAWINGS

Figure 1:
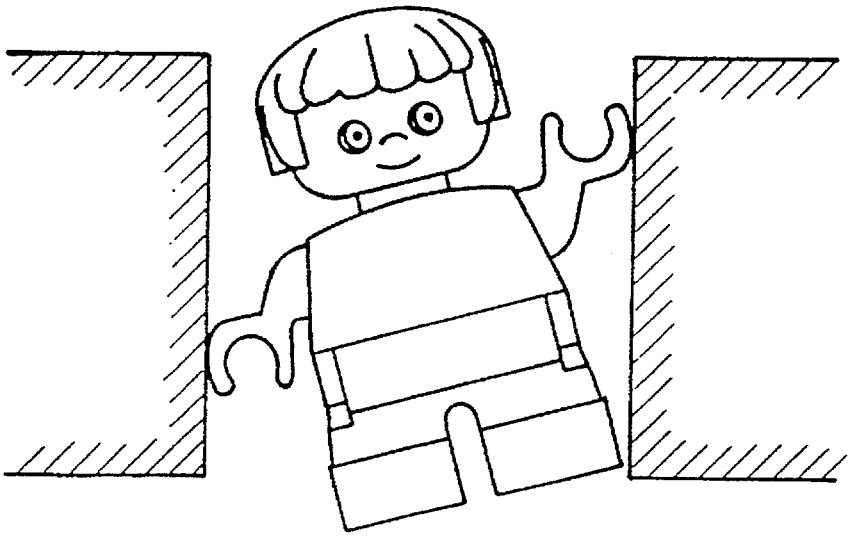
FIGS. 1 and 2 show the above-mentioned inexpedient structures.
Figure 2:
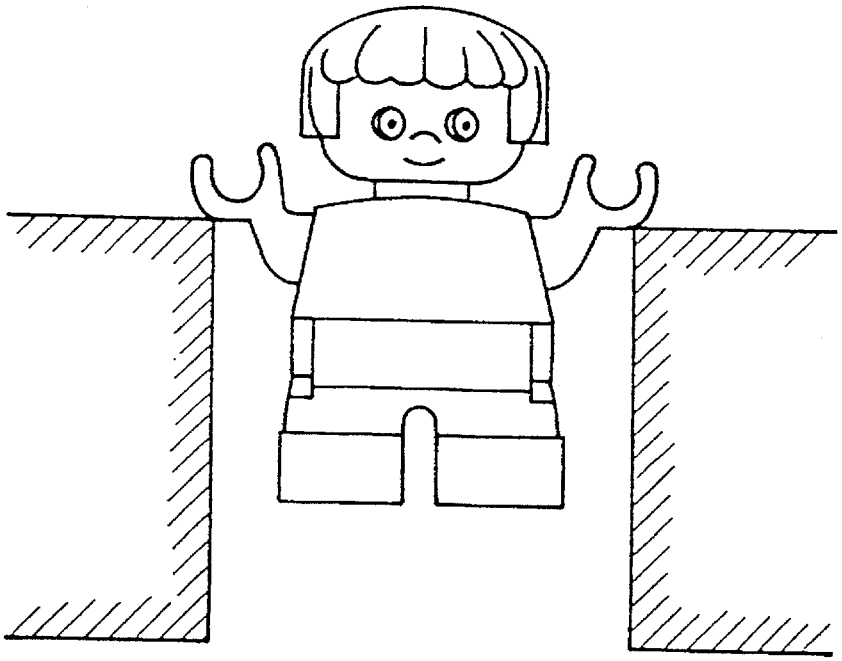
Figure 3:
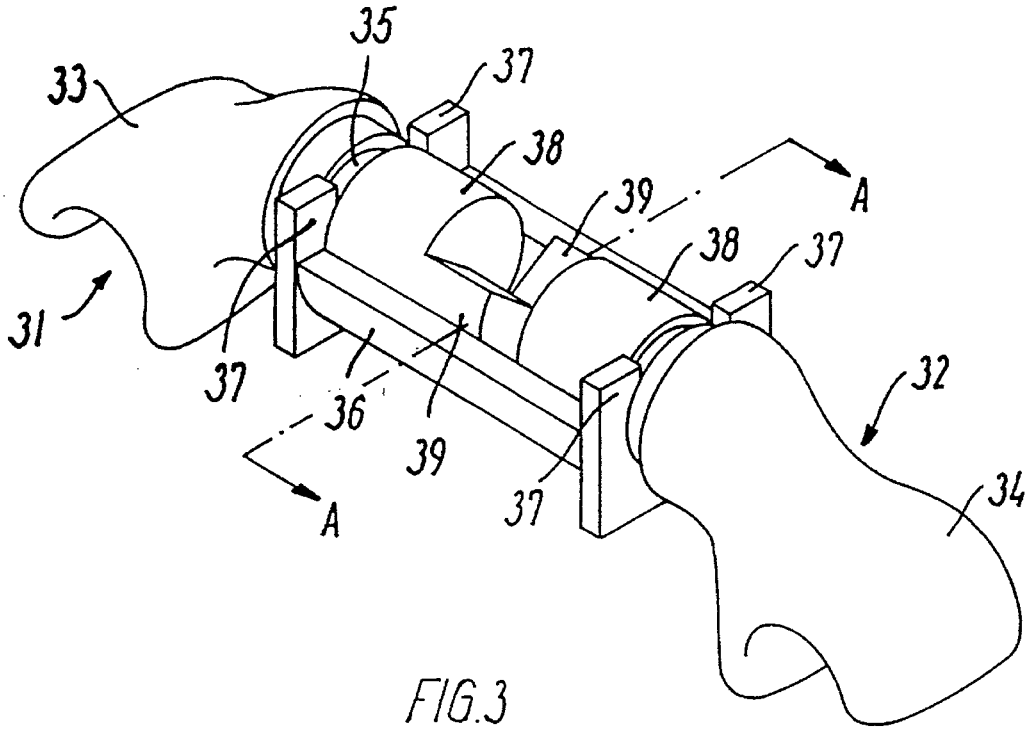
FIG. 3 is a perspective view of a preferred embodiment of a pair of arms for a toy figure according to the invention.

FIG. 3 shows a pair of identical arms 31, 32 for use in toy figures of the type which is shown in FIGS. 1 and 2, but in which the structure on the arms is different. The arms 31, 32 are identical and are arranged oppositely to each other, so that a hand 33, 34 on respective arms protrudes axially as well as asymmetrically in a radial direction, which means downwards in the case shown. Each of the arms has an annular groove 35, and the arms are placed in a holder having fork bearings at its opposed ends, said bearings being defined by grippers 37 which extend into the grooves 35 of the arm. The arms can thus rotate in the bearings, and the grippers 37 prevent axial movement of the arms with respect to the holder 36. In the holder 36, each of the arms has a cylindrical part 38 which is outwardly defined by the groove 35, and which has inward extensions in the form of cylinder sectors 39 which each protrude inwardly over the central plane and thus inwardly over each other.

Figure 4:
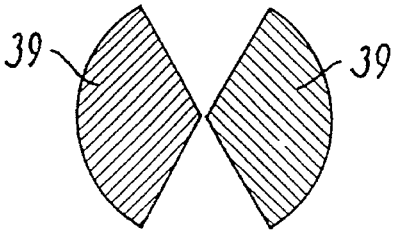
FIGS. 4 and 5 are vertical sections in the central plane of the arms in FIG. 3, i.e. along the line A—A.
Figure 5:
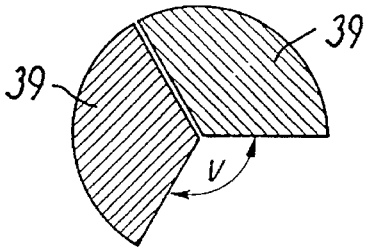

FIGS. 4 and 5 both show a section through the vertical sectional plane in FIG. 3. It is shown in FIG. 4 how the cylinder sectors 39, 39 are located with respect to each other when the arms 31, 32 in FIG. 3 assume co-parallel positions, e.g. with the hands 33, 34 pointing upwards. As mentioned, each of the arms can rotate in the bearings, and in FIG. 5 the cylinder sector of the one arm has been rotated with respect to that of the other, so that two of the radially and axially extending faces of the cylinder sectors contact each other. Further rotation of the arm in question causes the other arm to follow the rotation owing to the transfer of torque by the contact between the radially and axially extending, respective faces. It will be seen that the two arms hereby have a limited mutual rotatability, which is determined by the size of the angle v defined between two of the axially and radially extending faces of the respective cylinder sectors 39 which are not in contact with each other.

Each of the arms can thus rotate freely through the angle v with respect to the other; but the arms can never be placed e.g. in the unfortunate, mutual position which is shown in FIG. 1. It is clear that depending on the other dimensions of the toy figure some deviation from the position of the arms shown in FIG. 2 is permitted, but the toy figure will still observe the requirements made by said test type.

Figure 6:
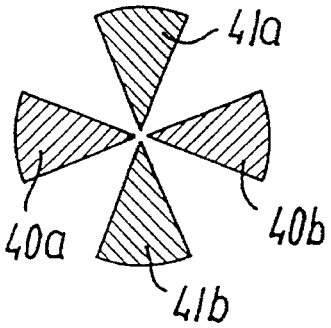
FIGS. 6 and 7 show vertical sections similar to FIGS. 4 and 5, but in an alternative embodiment.
Figure 7:
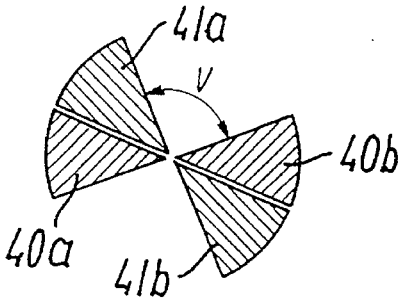

FIGS. 6 and 7, similar to FIGS. 4 and 5, show vertical sections through the central plane of an alternative embodiment. Here, each of the arms has two cylinder sectors 40*a*, 40*b* and 41*a*, 41*b*, respectively, so that the pair of cylinder sectors of each arm is positioned diametrically opposite each other with respect to the axis of rotation. FIG. 7 shows how the pair of cylinder sectors 41a, 41*b* is rotated with respect to the position in FIG. 6, so that these sectors contact the pair of cylinder sectors 40*a*, 40*b* on two axially and radially extending planes positioned diametrically opposite each other. With respect to the embodiment of FIGS. 3–5, a balanced transfer of force in the form of a pure torque about the common axis of rotation of the arms is obtained here.

We claim:

1. A toy figure comprising:

a body;

two opposed shoulders on said body;

a pair of arms, one arm extending from each of the shoulders, said arm being rotatably mounted along a common axis of rotation, said arms protruding asymmetrically transversely from the body in opposite directions parallel to said axis of rotation so as to define outer points;

said figure having a height extending in a direction transverse to the axis of rotation that is greater than the distance between said outer points; and each of said arms each having an engagement part extending toward the other arm in a direction parallel to the axis of rotation which engages the engagement part of the other arm, whereby a rotational engagement of the arms has a predetermined angular clearance so as to limit the relative rotatabilty of the arms with respect to each other.

2. A toy figure according to claim 1, wherein the engagement parts (39, 40*a*, 40*b*, 41*a*, 41*b*) are cylinder sectors with the axis of rotation as the cylinder axis.

* * * * *